United States Patent [19]

Theobald

[11] 4,440,122

[45] Apr. 3, 1984

[54] MODEL AIRPLANE ENGINE STARTER

[75] Inventor: Roger D. Theobald, Mission Veijo, Calif.

[73] Assignee: Cox Hobbies Inc., Santa Ana, Calif.

[21] Appl. No.: 349,054

[22] Filed: Feb. 16, 1982

Related U.S. Application Data

[63] Continuation of Ser. No. 114,247, Jan. 22, 1980, abandoned.

[51] Int. Cl.[3] ..... F02N 5/02

[52] U.S. Cl. ..... 123/185 D; 123/179 S; 185/41 A

[58] Field of Search ..... 123/185 D, 185 R, 179 S, 123/179 AS, 179 SE; 185/41 A, 41 R, 39

[56] References Cited

U.S. PATENT DOCUMENTS

| | | | |
|---|---|---|---|
| 2,727,590 | 12/1955 | Mattox | 123/179 S |
| 2,751,898 | 6/1956 | DeGroat | 123/179 AS |
| 2,927,660 | 3/1960 | DeGroat | 123/185 D |
| 3,070,081 | 12/1962 | Mercer et al. | 123/179 S |
| 3,094,109 | 6/1963 | Effinger, Jr. | 123/179 SE |
| 3,102,523 | 9/1963 | Frisbie | 185/41 R |
| 3,139,877 | 7/1964 | Graybill | 123/179 S |
| 3,159,154 | 12/1964 | Garofalo | 123/185 D |
| 3,250,265 | 5/1966 | Barr | 123/179 R |

FOREIGN PATENT DOCUMENTS

| | | | |
|---|---|---|---|
| 874628 | 8/1961 | United Kingdom | 123/179 S |

*Primary Examiner*—Andrew M. Dolinar

*Attorney, Agent, or Firm*—Schroeder, Siegfried, Vidas & Arrett

[57] ABSTRACT

A model internal-combustion engine having a rotatable shaft driven by an engine, a propeller secured to said shaft, and a self-starting mechanism in the form of a cylindrical hub mounted coaxially on the shaft against the propeller and having at one end an axially extending drive element at its periphery by means of which it drives the propeller and ramp-defining walls adjacent a spring-engaging element at its other end, and a helically wound spring surrounding the shaft, anchored at one end to a stationary part of the engine, and having a free end bearing against the hub with a hook formed thereon to automatically engage the spring-engaging element of the cylindrical hub and energize the spring when the propeller and hub are rotated in a contra-normal direction and to otherwise ride on the ramps of the hub in non-engaging relation to its spring-engaging element.

2 Claims, 4 Drawing Figures

MODEL AIRPLANE ENGINE STARTER

This is a continuation, of application Ser. No. 114,247, filed Jan. 22, 1980, now abandoned.

I. DESCRIPTION

Background of Prior Art

This invention relates to model internal-combustion engines. More particularly, it relates to a self-starter for such an engine.

Self-starters for model internal-combustion engines have been known for many years. Thus, U.S. Pat. No. 2,751,898, issued to Philip M. DeGroat, on Jan. 26, 1956, and entitled "Model Engine Starter" shows a self-starter of simple construction which must be manually applied to the propeller of the engine, for energization thereby and subsequent driving of the propeller in its normal direction upon release of same, to effect starting of the engine.

More recently, on Mar. 8, 1960, a second patent entitled "Self-Starter for Model Engines," issued to said Philip M. DeGroat, under U.S. Pat. No. 2,927,660. This patent discloses a much more complicated self-starter which requires a connected pair of springs, one of which is a leaf-spring and functions as a clutch and the other of which is a helically wound wire spring, and each of which rotates with the propeller. The two springs are in tandem and are automatically energized upon rotation of the propeller in a contra-normal direction.

The self-starter shown in the earlier of the above patents has a disadvantage in that it requires manual application and retention of the free end of the spring upon the propeller before rotation thereof, in a contra-normal direction, will energize the spring. In addition, experience has shown that from repeated usage, the spring member tends to become unduly extended and becomes engaged in the free running propeller with consequent serious damage. Moreover, it will not preclude the engine from running backwards which sometimes occurs, particularly with reed valve engines.

The latter of the two above patents shows a self-starting mechanism which does become engaged automatically after the propeller is rotated in a contra-normal direction but it requires two springs, one of which is a leaf-spring and functions as a clutch. This device is relatively complicated and expensive to manufacture. My self-starter is directed to eliminating each of the above disadvantages.

BRIEF SUMMARY OF INVENTION

The invention provides a simple and inexpensive device for application to a model internal-combustion engine which is of unusually light weight, has maximum crash proof features and characteristics, will automatically engage the propeller when the latter is rotated in a contra-normal direction, and will preclude the engine from running in reverse. It is comprised of a simple, cylindrical connector member which can be mounted upon the propeller shaft and a simple helically wound wire spring, one end of which is anchored to a stationary part of the engine and the other end of which has a hook element which bears against the hub member. The hub member has a recessed end into which the spring extends and the walls of the hub member which define the recess function as ramps upon which the hook member of the spring rides while the engine is free running.

It is a principal object of my invention to provide a self-starter mechanism for internal-combustion engines which will automatically become energized when the propeller is rotate in a contra-normal direction and is very simple and inexpensive to manufacture and assemble.

A more specific object is to provide a self-starter comprised only of a small plastic hub and a simple helically wound wire spring which can be quickly and easily assembled upon a model internal-combustion engine and will automatically energize when the propeller rotates in a contra-normal direction.

Another object is to provide a self-starter for a model internal-combustion engine which is very simple and inexpensive to manufacture and assemble, which is of unusually light weight, and has maximum crash proof features and characteristics.

Another object is to provide a self-starter for a model internal-combustion engine which will automatically become energized when the propeller is rotated in a contra-normal direction, will prevent the engine from running backwards, and is comprised of elements which are very simple and inexpensive to manufacture and apply to such an engine.

Another object is to provide an automatic self-starter for a model internal-combustion engine which is very simple and inexpensive to manufacture and can be readily and easily applied to pre-existing internal-combustion engines previously distributed to the trade.

Another object is to provide an automatic self-starter for a model internal-combustion engine which, upon slight modification in the manufacture of the propeller, may be comprised of a simple and very inexpensive helically wound spring.

These and other objects and advantages of my invention will more fully appear from the following description, made in connection with the accompanying drawings, wherein like reference characters refer to the same or similar parts throughout the several views, in which:

DETAILED DESCRIPTION OF THE INVENTION

Figure 1:
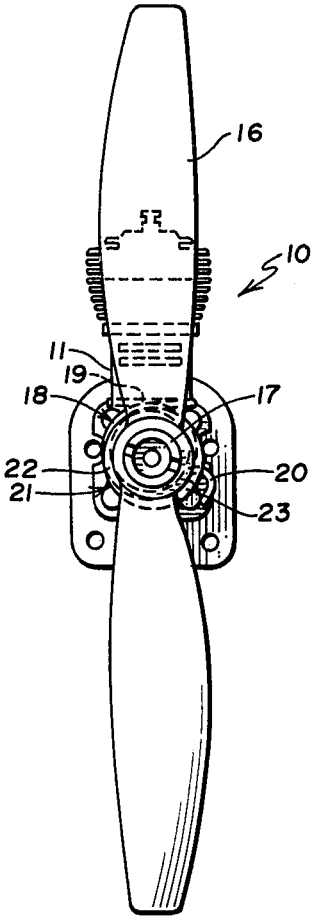
FIG. 1 is a front elevational view of a self-starting model internal-combustion engine embodying my invention.

One embodiment of my invention, as shown in FIGS. 1–4, inclusive, may include a conventional model internal-combustion engine 10 which includes a cylinder 11, a drive shaft 12 having its outer end threaded as at 13 and carrying a drive plate 14, a tubular journal 15 for the drive shaft, a propeller 16, and an internally threaded nut 17 which secures the propeller to the drive shaft in driven relation. The end of the drive plate 14 is serrated to drivingly engage the propeller, as is conventional.

My self-starter, as shown, includes a helically wound wire spring 18 which may, if desired, be made of wire such as described in U.S. Pat. No. 2,751,898. The inner end of this spring is formed into loop or anchor element 19 and extends around the cylinder 11 to anchor the spring thereto. Its other end is formed into a hook member 20 which extends radially outwardly in a radial plane from the end convolution. The anchor element 19 extends axially outwardly from the opposite end in a plane tangential to the convolution of the spring.

Figure 2:
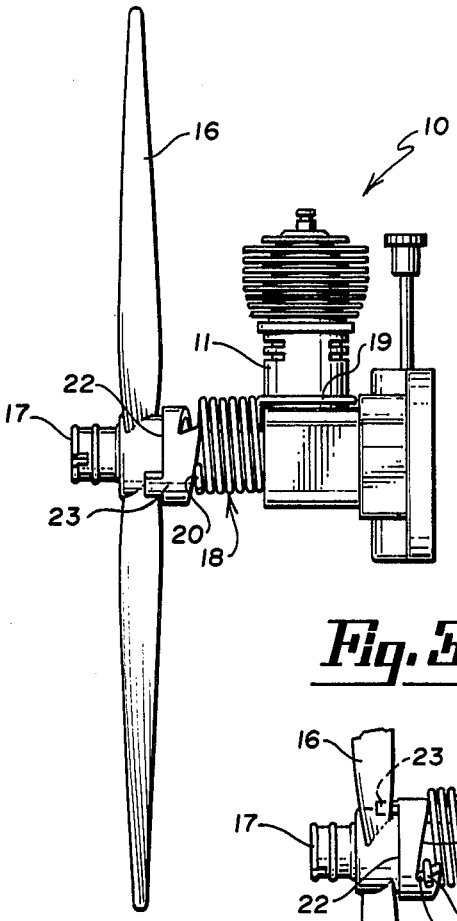
FIG. 2 is a left side elevational view of the same.
Figure 3:
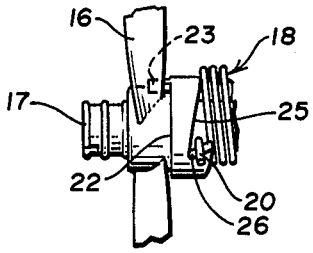
FIG. 3 is a partial left side elevational view of the same with the propeller and hub rotated in reverse sufficiently to cause the hub to engage the hook of the spring and energize the latter.
Figure 4:
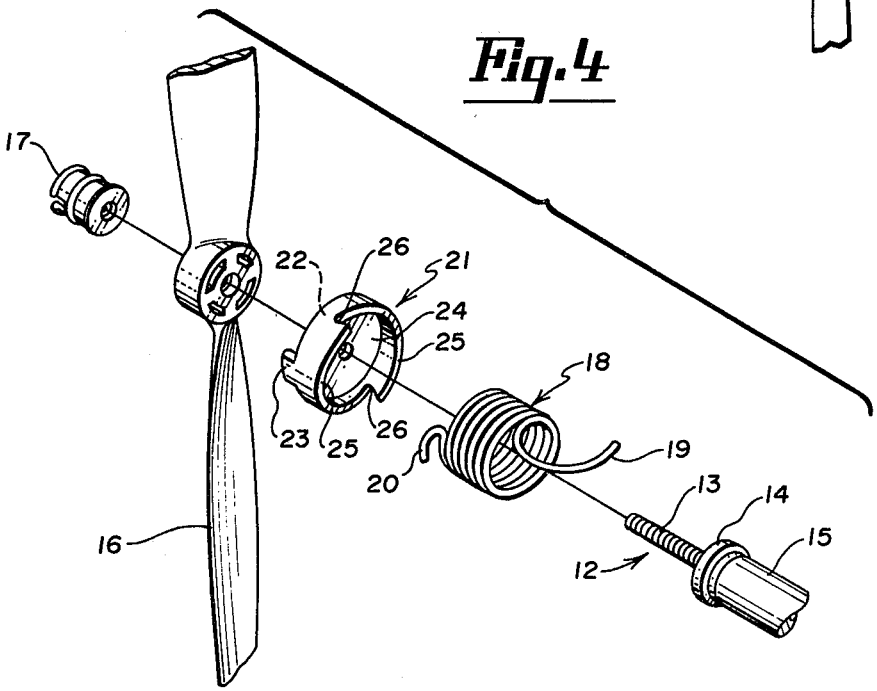
FIG. 4 is an exploded perspective view of the propeller and self-starter assembly elements, with the more remote parts of the propeller and propeller shaft broken away.

As shown in FIGS. 2–4, the spring 18 is mounted in coaxial surrounding relation to the drive shaft 12 and the tubular journal 15. It bears against the end of the crankcase of the engine 10 at one end and against a cylindrically-shaped hub member 21. This hub member 21 is mounted at its axis on drive shaft 12 and has a flat end 22 which bears against the propeller 16. It carries an axially outwardly extending drive element 23 at its periphery to engage and drive one blade of the propeller 16.

The opposite end of the hub member 21 is recessed as at 24 and has recess-defining peripheral walls which define ramps 25. As shown, these walls are cut inwardly at two points to define a spring-engaging element or tang 26. From these two points, the walls or ramps 25 slope axially outwardly away from the propeller until they reach the next spring engaging element 26, at which point the next inward cut has been made.

The diametrical dimensions of the recess 24 of the hub member 21 are slightly larger than the external diameter of the spring 18 so that the end of the latter which carries the hook 20 extends into the recess 24. As a consequence, the hook 20 rides upon the ramps 25 at all times as the propeller and hub member rotate while free running, and snaps into the recess adjacent the spring engaging element 26 of the hub each time that point passes the hook, and thereafter is gradually cammed axially away from the propeller until the next spring engaging element passes. It will be seen that the end of spring 18 is, therefore, at all times confined by portions of the ramps 25.

Although there is a slight drag created by the hook member 20 riding along the ramps 25, this drag is not appreciable and does not materially affect the operation or performance of the engine 10.

When it is desired to start the engine, the propeller 16 is merely rotated 1–2 turns in a contra-normal direction. When this is done, the hook 20 of the spring automatically engages one of the spring engaging elements 26, thereby causing the spring 18 to be energized. Upon release of the propeller, the spring rotates the propeller rapidly in its normal running direction, causing it to start. Thereafter, the hook member continues to ride upon the ramps 25 as hereinbefore described.

Many model engines are of the reed type and will run equally well in either direction. As a consequence, sometimes when an engine of this type falters, it will commence to run backwards. When this occurs, the hook 20 will automatically engage the element 26 and stop the engine.

It will be readily appreciated that the hub member 21 could readily be incorporated as an integral part of propeller 16 during the manufacture of the latter. In that event, only spring 18 as a separate part would be required to practice my invention. When the hub 21 is provided as a separate element, as shown, it may be applied to a previously existing engine.

From the above, it can be seen that I have provided an extremely simple and inexpensive self-starter which functions in an improved manner in that it automatically engages the propeller when the latter is rotated in a contra-normal direction. The hub member 21 may be manufactured very inexpensively from a plastic material. The spring member 18 likewise can be manufactured very inexpensively. Moreover, each of these members can be quickly, easily and inexpensively applied to a pre-existing model engine. These members can be easily and inexpensively maintained and are convenient for usual inspection. There is no danger of contamination to these members from fuel or oil congealing thereon together with dirt or foreign objects. They are unusually light weight, are easy to operate, and have maximum crash proof characteristics.

In addition to the above, my self-starter has an added advantage in that it will automatically prevent an engine upon which it is mounted from running backwards. In the event the engine does commence to run in reverse, the hook 20 will automatically engage the element 26 of the hub and will stop the engine as soon as the spring 18 has reached the upper limit of its energization.

It will, of course, be understood that various changes may be made in the form, details, arrangement and proportions of the parts without departing from the scope of my invention which consists of the matter shown and described herein and set forth in the appended claims.

I claim:

1. A self-starter for a model internal-combustion engine of the type having a source of power, a rotatable shaft operated by said source, and a propeller secured to said shaft, said starter comprising a coiled spring for mounting over said shaft in surrounding relation, and a connector constructed and arranged to be carried by said shaft in interconnecting driving relation between said spring and the propeller and in surrounding relation with at least one convolution of said spring, said connector having opposite ends and a propeller-engaging drive element extending outwardly from one of its ends to engage the propeller and be driven thereby therewith, said connector having a spring-engaging element at its opposite end constructed and arranged to be automatically engaged by said spring in biased relation whenever said connector is rotated in contra-normal direction by the propeller, said spring having a stationary end formed for attachment to the engine and having a free end formed for attachment to said connector, said free end being constructed and arranged to engage said spring-engaging element in biasing relation when said connector is rotated in a contra-normal direction and to bear against and ride upon one end of said connector in non-engaging relation to said element when said connector is rotated by the propeller in a normal direction.

2. A model internal-combustion engine having a rotatable shaft driven by said engine, a propeller secured to said shaft in driven relation for rotation thereof by said shaft, and a starting mechanism for said engine, said mechanism including, a spring member having one end anchored in fixed position to a stationary part of said engine, and the other end of said spring member being constantly positioned in automatically drivable relation with said propeller upon rotation of said propeller in a contra-normal direction whereby said spring member automatically will become energized upon rotation of said propeller in a contra-normal direction and, upon subsequent release of said propeller, will drive the same in its normal direction until de-energized, said starting mechanism including a driven recessed hub element disposed between said propeller and said other end of said spring member and connecting the same in interconnected driving relation and having a spring engaging element thereon, said hub element rotating with said propeller and having an arcuate ramp surface extending in an axial direction away from the point of driving connection of said hub element with said spring member contra to the normal direction of said propeller and away from said propeller and against which said other end of said spring member rides by means of which said propeller may rotate in its normal direction without energizing said spring member, said spring member being helically wound and, having at least one convolution thereof extending into the recess of said hub element and having a free end formed into a hook member which extends radially outwardly and engages said spring engaging element of said hub when the latter is rotated in a contra-normal direction with said propeller.

* * * * *